United States Patent [19]

Yamada et al.

[11] 4,182,634

[45] Jan. 8, 1980

[54] PROCESS FOR PURIFYING MALTOSE SOLUTION

[75] Inventors: Masaru Yamada; Atsushi Mori; Yoshiyasu Sato; Kenichi Terayama; Shogo Miyatani, all of Kitami, Japan

[73] Assignee: Hokkaido Sugar Co., Ltd., Tokyo, Japan

[21] Appl. No.: 898,073

[22] Filed: Apr. 20, 1978

[30] Foreign Application Priority Data

Apr. 21, 1977 [JP] Japan ..... 52-45175

[51] Int. Cl.[2] ..... C13D 3/12

[52] U.S. Cl. ..... 127/55; 127/53

[58] Field of Search ..... 127/53, 55

[56] References Cited

U.S. PATENT DOCUMENTS

| | | | |
|---|---|---|---|
| 2,504,169 | 4/1950 | Wolfrom et al. | 127/55 |
| 2,524,414 | 10/1950 | Wolfrom et al. | 127/55 X |
| 3,095,329 | 6/1963 | Giesen et al. | 127/55 |

*Primary Examiner*—Joseph Scovronek
*Assistant Examiner*—Roger F. Phillips
*Attorney, Agent, or Firm*—Oblon, Fisher, Spivak, McClelland & Maier

[57] ABSTRACT

From a maltose solution of a purity of 75 to 90%, a high-purity maltose solution having a maltose purity of more than 98.5% is obtained in a high yield by preparatorily treating activated carbon with the aqueous solution of an organic solvent, adding the same organic solvent to the maltose solution under treatment until the concentration of the organic solvent equals that in the aqueous solution used for the treatment of the activated carbon, and subsequently bringing the resultant solution into contact with the activated carbon for thereby allowing the activated carbon to adsorb selectively out of the solution only the saccharides such as maltotriose and maltotetraose which are composed of three or more glucoses.

4 Claims, 3 Drawing Figures

Fig_1
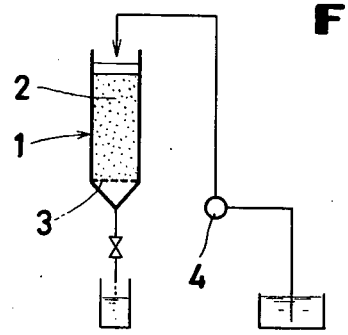
PRIOR ART
Fig_2
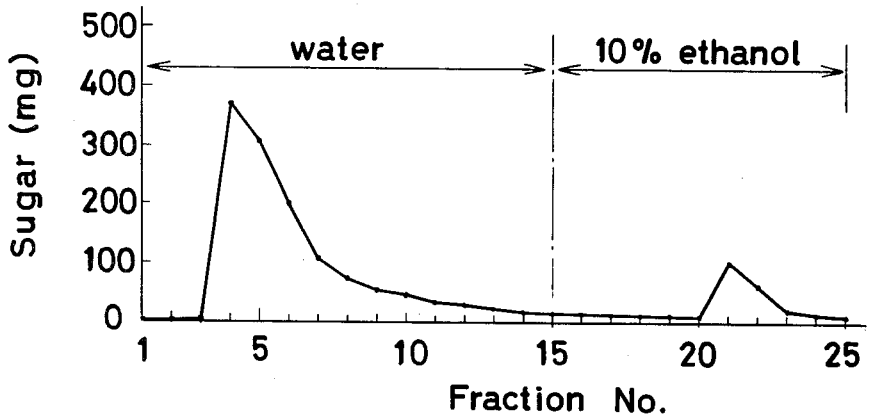
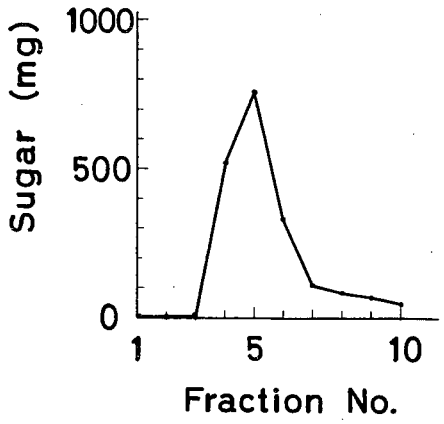
Fig_3

PROCESS FOR PURIFYING MALTOSE SOLUTION

BACKGROUND OF THE INVENTION

This invention relates to a process for purifying to a higher degree by the use of activated carbon and an organic solvent a maltose solution of a purity of 75 to 90% which is obtained by hydrolyzing starch and subsequently subjecting the resultant hydrolyzate to an ordinary method of purification.

Maltose is a disaccharide sugar composed of two glucose molecules. Its sweetness is rated at one third of that of sugar, maltose is possessed of properties similar to those of sugar and is characterized by its high anticeptic effect and high moisture retaining property.

In recent years, more people have come to favor foods that are only mildly sweet. Use of maltose as a way of decreasing sweetness and, at the same time, retaining other properties intact or having them enhanced, is gaining popularity and use of maltose is increasing. Examples of maltosecontaining products currently available in the market include malt syrup, high-maltose syrup and plain maltose. The maltose purities in these commercial products are respectively on the order of 20 to 30%, 40 to 50% and 75 to 90%. These products are used in confectioneries and other foodstuffs. In addition, maltose finds utility as a medium for microorganic cultivation and as a raw material for industries in general. Further, maltose purified to an exceptionally high purity of more than 98.5% is used in medicines, especially in solution (for injection) intended for supplementing the sugar supply of patients of diabetes mellitus.

Various methods for producing maltose have been known and the purity of the maltose obtained by these methods has been on the order of 75 to 90%. A typical example of these methods comprises heating and treating with $\alpha$-amylase a starch slurry prepared by suspending starch in water for thereby liquefying the starch, hydrolyzing the liquefied starch with $\beta$-amylase and $\alpha$-1,6-glucosidase to afford a maltose solution, then filtering the maltose solution and subsequently subjecting the filtrate to an ordinary purifying treatment such as by use of activated carbon and an ion-exchange resin. The purity of the maltose product thus obtained is from 75 to 90%. The greater part of the impurities in this maltose solution comprises glucose and those oligosaccharides such as maltotriose and maltotetraose which are composed of three or more glucose units. For the maltose solution mentioned above to be useful as a medicine or reagent, it must be purified further.

For the purpose of this further purification of the maltose solution, there has been used a method involving the crystallization of maltose. The crystallization of maltose is accomplished by a method using an organic solvent or a method of boiling.

In the case of the method involving the use of an organic solvent, ethanol or some other suitable organic solvent is added to the maltose solution to lower the solubility of maltose and allow the maltose selectively to be crystallized out. This method, however, has a disadvantage in that such oligosaccharides as maltotriose and maltotetraose which coexist in the solution are also crystallized out at the same time. There is another disadvantage that, when this method is practised on a commercial scale, the operation proves uneconomical because the amount of the organic solvent used as described above is very large and because the crystals of maltose produced are too fine to permit efficient recovery thereof.

In the case of the method by boiling, the maltose solution is concentrated to a fixed degree of supersaturation and, in the course of boiling, seed sugar is added thereto to permit selective growth of maltose crystals. This method also has a disadvantage that the growth of maltose crystals is impeded by the oligosaccharides such as maltotriose and maltotetraose coexisting with maltose in the solution, the growth of crystals requires a long time, the formed crystals are not capable of efficient centrifugal separation and the efficiency of recovery of these crystals is extremely poor.

There has also been disclosed a process for producing maltose of high purity free from glucose and oligosaccharides composed of three or more glucose units, which process comprises treating the liquefied starch solely with $\beta$-amylase for thereby hydrolyzing the glucose chain of starch molecule into maltose units gradually from the nonreducing end inwardly while allowing the remaining portion of the glucose chain posterior to the point of branching, namely $\beta$-limit dextrin, to remain unhydrolyzed in the original form of a large molecule, and adding a suitable amount of an organic solvent to the resultant hydrolyzate for thereby precipitating and separating the $\beta$-limit dextrin. This method, however, has a disadvantage that the yield of maltose on the basis of starch is only on the order of 30 to 40%.

An object of this invention is to provide a process for the purification of a maltose solution which is free from the various disadvantages suffered by the conventional methods for the purification of maltose, specifically a process for recovering a maltose solution of a high purity of more than 98.5% in a high yield from a maltose solution of a purity of 75 to 90% by removing from the original maltose solution those highly obstinate oligosaccharides, such as maltotriose and maltotetraose, composed of three or more glucose units.

Buy the words "maltose solution" used in the present specification is meant a solution wherein the principal component of the solids present therein is maltose and the other components thereof are glucose and oligosaccharides composed of three or more glucose units.

The words "maltose purity" are used herein to mean the pure maltose content in the solids present in a given maltose product.

The words "high-purity maltose solution" mean a solution whose maltose purity is more than 98.5%.

SUMMARY OF THE INVENTION

To accomplish the object described above according to this invention, there is provided a process for the purification of a maltose solution, which process comprises bringing activated carbon into contact with the aqueous solution of an organic solvent, adding the same organic solvent to the maltose solution under treatment until the concentration thereof equals that in the aforementioned aqueous solution of organic solvent, feeding the maltose solution onto a bed of the activated carbon already treated with the aforementioned aqueous solution of organic solvent, supplying to the bed the same aqueous solution of organic solvent as that used for the contact with the activated carbon, recovering a maltose-rich fractional eluate from the resultant eluate issuing from the bed, and separating the organic solvent from the maltose-rich fractional eluate.

In the process of purification according to this invention, the activated carbon to be used is treated in advance with the aqueous solution of an organic solvent and, to the maltose solution subjected to the treatment, the same organic solvent as mentioned above is added until the concentration thereof equals that in the aforementioned aqueous solution of organic solvent, so that when the maltose solution comes into contact with the activated carbon, the affinity of the activated carbon for maltose is weaker than for those oligosaccharides, such as maltotriose and maltotetraose, composed of three or more glucose units and, as the result, these oligosaccharides are preferentially adsorbed by the activated carbon and the maltose is eluted alone. Thus, there is obtained a maltose solution of high purity. According to the process of purification of this invention, since the activated carbon adsorbs substantially no maltose, the recovery ratio of maltose is notably high.

The other objects and characteristics of this invention will become apparent from the description of invention to be given hereinafter with reference to the accompanying drawings.

BRIEF EXPLANATION OF THE DRAWING

FIG. 1 is an explanatory diagram illustrating a system which can be used in both a prior art process and in one preferred embodiment of the process for the purification of a maltose solution according to the present invention.

FIG. 2 is a graph showing the sugar contents of each of the fractional eluates from the treatment according to the conventional method.

FIG. 3 is a graph showing the sugar contents of each of the fractional eluates from the treatment according to the present invention.

DESCRIPTION OF PREFERRED EMBODIMENTS:

As already described, the major part of the impurities in the maltose solution of a maltose purity of 75 to 90% obtained by hydrolysis of starch are oligosaccharides composed of three or more glucose units such as maltotriose and maltotetraose (hereinafter referred to briefly as "maltotriose, etc."), with glucose accounting for the remainder of the impurities. Methods for repressing the formation of glucose in the maltose solution and methods for removing the formed glucose are already known to the art. Thus the presence of glucose poses virtually no problem in the purification of maltose. The isolation of maltose from the maltotriose, etc., however, has remained as a difficult problem. High-purity maltose freed from the maltotriose, etc. by the conventional technique has been obtained with an inevitable sacrifice of the recovery ratio of maltose from the starch under treatment.

The inventors continued a study and repeated experiments in search of a method capable of readily removing the maltotriose, etc. and accordingly affording maltose of higher purity in a higher yield than the conventional method. They have, consequently, ascertained that the maltose solution given to be treated can be purified into a maltose solution of a maltose purity of more than 98.5% by a process which comprises preparatorily treating activated carbon with the aqueous solution of an organic solvent, simultaneously adding to the initial maltose solution the same organic solvent until the concentration thereof equals that in the aforementioned aqueous solution, and bringing the organic solvent-containing maltose solution into contact with the activated carbon already treated as described above for thereby allowing the activated carbon to adsorb only the maltotriose etc. This invention has been accomplished on the basis of this knowledge.

Methods capable of fractionating saccharides by use of activated carbon have been known in the art. For example, on pages 221–222 of the Biochemical Research Methods (Lipids and Carbohydrates) published in Japan by Asakura Shoten on June 30, 1971, there is described a method for fractionating hydrolyzate of cellulose (which differs from the hydrolyzate of starch in terms of the linkage of glucose units) by use of activated carbon.

As the first step, the inventors attempted purification of maltose by this method: In a system as illustrated in FIG. 1, activated carbon of the chromatography grade was converted into slurry by addition of water and a 30-ml portion of the slurry was packed on a porous plate 3 in a glass column 1, 16mm in inside diameter and 200 mm in length. Concentrated hydrochloric acid in a volume equalling that of the activated carbon was slowly passed through the bed of activated carbon 2 in the glass column 1. After this treatment, the activated carbon bed was washed with an ion-exchanged water until the pH value of the washings reached 4.5.

Onto the activated carbon bed which had been treated as described above, a maltose solution containing solids whose concentration is 42.0% and whose composition is as shown in Table 1 was supplied in an amount corresponding to 70 mg of reducing sugar per ml of activated carbon. Then, by means of a pump 4, the ion-exchanged water which was deionized with ion-exchange resins was sent to the activated carbon bed at the rate of 60 ml per hour, with the eluate from the column divided into a total of fifteen 10-ml fractions, whereafter an aqueous 10% ethanol solution was supplied at the same flow velocity as the ion-exchanged water to the activated carbon bed, with the eluate similarly divided into a total of ten 10-ml fractions.

Table 1

| | |
|---|---|
| Glucose | 0.4% |
| Maltose | 88.6% |
| Maltotriose | 7.4% |
| Others | 3.6% |

The reducing sugar content was determined by the SomogyiNelson method. Specifically, this determination was carried out by reducing a copper reagent with the reducing sugar under test to produce $Cu_2O$ and allowing the solution to develop a color by the $Cu_2O$ reducing arsenic-molybdic acid into molybdenum blue and subjecting the solution to colorimetry involving the comparison of the developed color with the color produced similarly by using the standard solution of reducing sugar (standard solution of maltose in the present case). In the present case, therefore, the reducing sugar is represented as the content of maltose and hereinafter referred to briefly as "sugar."

The contents of "glucose", "maltose" and "maltotriose" given in the Table above are the percentages of the respective saccharides present in the solids taken as 100%, determined by means of gas chromatography. The content of "others" is the balance found by subtracting the sum of the three percentages indicated above from 100. Accordingly, the "others" are accounted for by oligosaccharides having four or more glucose units, other solid components and/or a slight error of measurement.

The fractional eluates were assayed for sugar content. The results were as shown in FIG. 2. In the graph of FIG. 2, the fraction numbers are indicated along the horizontal axis and Fraction Nos. 1 through 15 represent the fractions of the eluate resulting from the ion-exchanged water and Fraction Nos. 16 through 25 the fractions of the eluate resulting from the aqueous 10% ethanol solution. The vertical axis of the graph is graduated for the sugar content. It is seen from the graph that the first elution of sugar in the eluate began in Fraction No. 4, that the total of sugar contained in the eluate of Fraction Nos. 4 through 8 was 50.9% based on the amount supplied and that in the case of the eluate resulting from the aqueous 10% ethanol solution, the total of sugar contained in the five fractions of the highest sugar contents (Fraction Nos. 21 through 25) was 10.4%. The combination of Fraction Nos. 4 and 5 and that of Fraction Nos. 21 and 22 were respectively assayed. The results were as shown in Table 2.

Table 2

| | Glucose (%) | Maltose (%) | Maltotriose (%) | Others (%) |
|---|---|---|---|---|
| Fraction Nos. 4 and 5 combined | 0.4 | 94.0 | 2.1 | 3.5 |
| Fraction Nos. 21 and 22 combined | 0 | 98.8 | 0.7 | 0.5 |

It is evident from Table 2 that the solids present in the combination of Fraction Nos. 4 and 5 still contained 5.6% of the maltotriose, etc., as the impurities, although there was increased maltose purity. This large content of maltotriose, etc. in the eluate may be due to the fact that supplying of 70 mg of the maltose solution as a reducing sugar per ml of activated carbon was an overload.

When the passage of the aqueous 10% ethanol solution was started after completion of the passage of the ion-exchanged water, the second peak of sugar elution in the eluate appeared in Fraction Nos. 21 and 22. The combination of these two fractions had a fairly higher maltose purity than the combination of the fractions involving the first peak of sugar elution and still contained 1.2% of maltotriose, etc.

All the results so far discussed indicate that if the purification of the maltose solution described above is carried out by the conventional method resorting to chromatography using activated carbon, the recovery ratio of sugar is low and the maltose purity is not increased so much as might be hoped. If the maltose solution is desired to be purified to a still higher purity, the amount of sugar to be supplied for a unit amount of activated carbon must be decreased. Thus, it becomes necessary either to decrease the amount of the maltose solution to be treated or to increase the activated carbon.

It is now evident that if the maltose solution having a maltose purity of 75 to 90% is purified completely by chromatography using activated carbon on a commercial scale, the operation will prove highly disadvantageous from the economic point of view because the consumption of activated carbon will be large and the recovery ratio of sugar will be notably low.

The poor recovery ratio of sugar, particularly maltose, which is obtained in the operation according to the method described above is believed to be ascribable to the strong adsorbing power the activated carbon exhibits on the sugar present in the maltose solution. The deficient separation of maltose from the maltotriose, etc. may well be due to the fact that since the maltose is present in an over-whelmingly large amount, it is adsorbed by the activated carbon despite the higher affinity the activated carbon has for the maltotriose, etc. than for maltose and, consequently, the adsorbing capacity of the activated carbon for the maltotriose, etc. is lowered to the extent of compelling the maltotriose, etc. to be eluted in conjunction with maltose.

The same method was also tested by using a granular activated carbon, but the recovery ratio of sugar was much lower. A possible reason for this inferior recovery may be that the sugar is occluded and adsorbed more powerfully within the particles of activated carbon.

In due consideration of the results of the experiments described above, the inventors continued further study and have, consequently, found that the affinity of the activated carbon for the maltose is weakened and the amount of the maltotriose, etc. to be adsorbed by the activated carbon is conversely increased by allowing an organic solvent of suitable concentration to be present from the beginning when the maltose solution is brought into contact with the activated carbon.

The process for the purification of a maltose solution according to the present invention, accordingly, comprises bringing the activated carbon preparatorily into contact with the aqueous solution of a specific organic solvent and, in the meantime, adding to the maltose solution subjected to the treatment the same organic solvent as mentioned above until the concentration thereof equals that in the aqueous solution of organic solvent already used for contact with the activated carbon, then bringing the maltose solution into contact with the pretreated activated carbon and feeding the aforementioned aqueous solution of organic solvent as the eluent for thereby allowing the activated carbon to adsorb the maltotriose, etc. efficiently. Thus, there is obtained a high-purity maltose solution.

The activated carbon which is usable in the present invention is required to be free of a property of absorption. The activated carbon of chromatography grade is a preferred choice.

Ordinary maltose solutions obtained by the hydrolysis of starch are usable for the purpose of the treatment contemplated by this invention. The method used for the preparation of the maltose solution for use in this treatment is not critical. When prepared by the hydrolysis of starch, the maltose purity in the products generally ranges from 75 to 90%. The value of the maltose purity is not critical. The process of this invention provides efficient purification insofar as the principal components of the solids present in the maltose solution are maltose and the maltotriose, etc. Since the process of this invention is incapable of separating glucose from maltose, it is desirable to use as the maltose solution the hydrolyzate of starch having a low glucose content in order that the produced maltose may have a high maltose purity and the otherwise required additional treatment for the removal of glucose may be eliminated.

To select organic solvents of the kind advantageously usable in this invention and find their optimum concentration for the process, five glass columns were packed each with the activated carbon bed under the same conditions as in the case of the experiment described above with reference to FIG. 1 and, through the packed beds, aqueous methanol solutions having different methanol concentrations of 3.0, 4.0, 5.0, 6.0 and 10.0% were respectively passed, then methanol was added to five aliquot portions of the maltose solution having the same composition as shown in Table 1 until their respective concentrations reached the same values 3.0 through 10.0% as mentioned above, the resultant methanol-containing maltose solutions were supplied respectively to the activated carbon beds pretreated with the aqueous methanol solutions of the same concentrations, and the aqueous methanol solutions having the same methanol concentrations were fed as the respective eluents to the activated carbon beds. The eluate from each column was collected in successive 10-ml fractions. Of the fractions thus obtained, the five fractions which had the highest sugar contents were combined and the combined eluate was assayed to determine the recovery ratio of sugar and the composition of sugar. The results were as shown in Table 3.

Table 3

| Methanol concentration (%) | Amount of sugar added (mg/ml of activated carbon) | Recovery ratio of sugar (%) | Sugar composition (% based on solids) | | | |
|---|---|---|---|---|---|---|
| | | | Glucose | Maltose | Maltotriose | Others |
| 3.0 | 73.2 | 50.3 | 0.3 | 93.9 | 2.2 | 3.6 |
| 4.0 | 73.4 | 77.4 | 0.3 | 98.9 | 0.4 | 0.4 |
| 5.0 | 74.1 | 87.4 | 0.3 | 99.4 | 0 | 0.3 |
| 6.0 | 73.0 | 75.1 | 0.4 | 99.1 | 0 | 0.5 |
| 10.0 | 74.0 | 93.9 | 0.4 | 93.7 | 2.3 | 3.6 |

The procedure described above was faithfully repeated, except that ethanol was used in the place of methanol as the organic solvent. The results were as shown in Table 4.

Table 4

| Ethanol concentration (%) | Amount of sugar added (mg/ml of activated carbon) | Recovery ratio of sugar (%) | Sugar composition (% based on solids) | | | |
|---|---|---|---|---|---|---|
| | | | Glucose | Maltose | Maltotriose | Others |
| 3.0 | 73.2 | 50.0 | 0.3 | 93.7 | 2.4 | 3.6 |
| 5.0 | 73.4 | 81.5 | 0.3 | 99.3 | 0 | 0.4 |
| 6.0 | 74.1 | 75.0 | 0.4 | 99.0 | 0 | 0.6 |
| 10.0 | 74.0 | 93.5 | 0.4 | 93.4 | 2.6 | 3.6 |

The same experiment was repeated by using acetone, propanol and butanol in the place of methanol or ethanol as the organic solvent. With acetone, there were obtained substantially the same results as those obtained with methanol or ethanol. With propanol or butanol, however, the separation of maltose from other oligosaccharides was not satisfactorily obtained. From the foregoing results, it is learnt that methanol, ethanol or acetone is used advantageously as the organic solvent and the desirable range of concentration is from 4 to 6%.

To determine the optimum amount in which the sugar is added per ml of the activated carbon, the maltose solution was fed as the reducing sugar in two different amounts of 100 mg and 75 mg per ml of the activated carbon, with methanol used as the organic solvent at a fixed concentration of 5% and the eluates were assayed for sugar composition. The results were as shown in Table 5. From the results, it is seen that the amount of the sugar to be added should be smaller than 100 mg per ml of the activated carbon in order that the elution of impurities or oligosaccharides such as maltotriose and maltotetraose may be minimized.

Table 5

| Amount of sugar added (mg) | Glucose (%) | Maltose (%) | Maltotriose (%) | Others (%) |
|---|---|---|---|---|
| 100 | 0.3 | 97.0 | 0.3 | 2.4 |
| 75 | 0.3 | 99.4 | 0 | 0.3 |

The results given above were obtained in the experiment performed at room temperature (about 20° C.). Then, the experiment was repeated with the amount of added sugar fixed at 75 mg and the activated carbon bed, the maltose solution subjected to the treatment and the aqueous 5% methanol solution as the eluent heated to three different temperatures of 25° C., 50° C. and 60° C. The eluate from the column obtained in each test run was collected in 10-ml fractions. The five fractions having the highest sugar contents were combined and the combined eluate was assayed to determine the recovery ratio of sugar and the composition of sugar. The results were as shown in Table 6.

Table 6

| Temperature of treatment (°C.) | Recovery ratio of sugar (%) | Sugar composition (% based on solids) | | | |
|---|---|---|---|---|---|
| | | Glucose | Maltose | Maltotriose | Others |
| 25 | 85.4 | 0.3 | 99.3 | 0 | 0.4 |
| 50 | 90.3 | 0.3 | 99.5 | 0 | 0.2 |
| 60 | 91.1 | 0.3 | 99.3 | 0 | 0.4 |

It is evident from the foregoing table that the recovery ratio was higher and the results were more satisfactory when the treatment for purification was performed at temperatures of 50° and 60° C. than at room temperature. Further in the test runs involving the temperatures of 50° and 60° C., the time required for the elution was 10 to 20% less than in the test run performed at room temperature. As regards the possible contamination which often poses a problem when the purification with activated carbon is practised on a commercial scale, use of the temperature of 50° C. to 60° C. has an additional effect of precluding this problem.

The contact of the maltose solution with the activated carbon is generally effected by a method of packing a column with the activated carbon and passing the maltose solution through the activated carbon bed in the column. Alternatively, there may be used a method which uses a horizontal column packed with activated carbon, passes the maltose solution and the eluent forcibly through the activated carbon bed and, on completion of their passage, changes the spent activated carbon. The activated carbon which has passed a stated amount of the maltose solution can easily be reactivated by washing out the adsorbate by use of an aqueous solution containing the same organic solvent at a higher concentration than in the aqueous solution used as the eluent and subsequently treating the washed carbon with a strong acid. Thus, the activated carbon can be used repeatedly. The treatment of the maltose solution by the process of this invention, therefore, can be carried out semi-batchwise by using a plurality of columns packed with the activated carbon and carrying out the supply of the maltose solution, the elution and the regeneration of the used activated carbon in the individual columns on a properly staggered time schedule.

The time zone in which the maltose-rich eluate emanates from the activated carbon bed is substantially fixed insofar as the composition of the maltose solution and the conditions of elution are constant. By inserting in the path for the eluate a switch valve adapted to open and close on lapse of fixed time intervals and timing the change of receptacles for the eluate in accordance with the operation of said switch valve, therefore, only the maltose-rich eluate can easily be collected.

For the treatment of the eluate which is directed to the isolation of the organic solvent from the maltose solution, use of an ordinary method of distillation will suffice. The organic solvent thus removed can be recovered to be used for the pretreatment of the activated carbon, the addition to the maltose solution and the preparation of the eluent.

The process for the purification of a maltose solution according to the present invention, as is clear from the detailed description given to this point, causes the activated carbon to be pretreated through contact with the aqueous solution of an organic solvent and the maltose solution subjected to the treatment to be added by the same organic solvent as mentioned above until the concentration of the added organic solvent equals that in the aqueous solution used in the pretreatment of the activated carbon and, thereafter, allows the maltose solution now containing the organic solvent to come into contact with the pretreated activated carbon, whereby the maltotriose, etc. are adsorbed by the activated carbon and the maltose is substantially wholly released without being adsorbed by the activated carbon. Thus, the process affords a high-purity maltose solution in high yields and suffers substantially no loss of maltose.

In the case of a maltose solution rich in glucose, a high-purity maltose solution can be obtained by preparatorily treating this solution by a known method of glucose removal such as, for example, a method which comprises converting glucose into gluconic acid by the action of glucose oxidase, and subsequently removing the gluconic acid by means of an ion-exchange resin and, thereafter, subjecting the remaining maltose solution to the purification by the process of this invention. Alternatively, high-purity maltose solution can be obtained from this glucose-containing maltose solution by first subjecting the original maltose solution to the purification treatment of this invention for thereby removing the maltotriose, etc, and subsequently performing the aforementioned boiling method on the resultant maltose solution for thereby effecting crystallization of maltose and allowing the glucose to remain in the mother liquor.

The maltose solution purified by the process of this invention was tested with animals to determine whether it contained any pyrogenic substance or not. It showed negative test for pyrogenic substance. Thus there is a fair possibility that the maltose solution is usable for medicines.

Now, the present invention will be described more specifically with reference to examples. It should be noted that the present invention is not limited to these examples.

EXAMPLE 1

By addition of water, 30 ml of activatec carbon sold by Wako Junyaku Co., Ltd. of Japan under the tradename of "Chromatography-grade Activated Carbon" was converted into slurry. The slurry was deaerated by vacuum swelling and then poured into a column (glass tube 1.6 cm in inside diameter and 20 cm in length) as illustrated in FIG. 1 and given an acid treatment by passing therethrough concentrated hydrochloric acid of the same volume as that of the activated carbon. Thereafter, the activated carbon bed was washed with an ion-exchanged water until the pH value of the washings rose above 4.5.

Then, an aqueous 5% methanol solution was passed through this column to expel the water from the bed. A maltose solution having methanol added to a methanol concentration of 5% was added to the top portion of the column in an amount corresponding to 74.1 mg of sugar per ml of the activated carbon. This maltose solution had a solids content of 42.0% and the solids were composed of 0.4% of glucose, 88.6% of maltose, 7.4% of maltotriose and 3.6% of others.

Subsequently, an aqueous 5% methanol solution was fed to the column at a flow rate of 60 ml/hour and the eluate from the column was received successively in 10-ml fractions.

The fractions thus obtained were assayed for sugar content (by the Somogyi-Nelson method) and the five fractions shown to have the highest sugar contents were combined and assayed by gas chromatography for sugar composition.

It was found consequently that the amount of sugar contained in the five fractions from the peak phase of sugar elution was 87.4% of the amount of sugar added to the column. The sugar was composed of 0.3% of glucose, 99.4% of maltose, 0% of maltotriose and 0.3% of others based on the solids content.

EXAMPLE 2

A column was prepared by giving the packed activated carbon the same acid treatment and rinsing as those in Example 1. An aqueous 5% ethanol solution was passed through this column to displace the water remaining in the bed. Then a maltose solution having the same composition as that used in Example 1 and having ethanol added thereto to an ethanol concentration of 5% was added to the column in an amount corresponding to 73.4 mg of sugar per ml of the activated carbon. Subsequently, an aqueous 5% ethanol solution was passed through the column.

The recovery of the eluate in fractions and the assay of the fractions were carried out after the manner of Example 1. The amounts of sugar contained in the fractions were as shown in the graph of FIG. 3. In the graph, Fraction Nos. are indicated along the horizontal axis and the sugar contents of the fractions are shown against the vertical axis. It is learnt from this graph that substantially no sugar was contained in the first 30 ml of the eluate and the elution of sugar began to appear in Fraction No. 4. The total amount of sugar contained in the eluate of Fraction Nos. 4 through 8 was 81.5% of the total amount of sugar added to the column. The sugar was composed of 0.3% of glucose, 99.3% of maltose, 0% of maltotriose and 0.4% of others based on the solids content.

The purified maltose solution obtained as described above was made free from microorganisms, filtered and dried and, thereafter, tested on rabbits by the method designated in the Japanese Pharmacopoeia to determine whether or not it contained any pyrogenic substance. Specifically, this test was performed by dissolving 2 g of dry maltose obtained as above in an injection-grade distilled water to a total volume of 22 ml, injecting the resultant maltose solution to rabbits at a rate of 10 ml per kg of body weight and measuring the body temperatures. The results were as shown in Table 7. The rises of body temperature in the three rabbits totalled 0.51° C. Thus, the maltose showed a negative test for pyrogenic substance.

Table 7

| Run No. of rabbits | 1 | 2 | 3 |
|---|---|---|---|
| Body weight (Kg) | 2.00 | 2.11 | 2.10 |
| Injection volume (ml) | 20 | 21 | 21 |
| Body temperature measured (°C.) | | | |
| Two hours before injection | 39.03 | 39.06 | 38.84 |
| One hour before injection | 39.14 | 39.05 | 39.02 |
| Immediately before injection | 39.17 | 39.17 | 39.24 |
| One hour after injection | 39.29 | 39.06 | 39.23 |
| Two hours after injection | 39.50 | 39.11 | 39.48 |
| Three hours after injection | 39.29 | 38.91 | 39.40 |
| Rise of body temperature (°C.) | 0.33 | −0.06 | 0.24 |
| Pyrogenic reaction | (−) | (−) | (−) |

EXAMPLE 3

Through the activated carbon bed used in Example 1, 150 ml of an aqueous 35% methanol solution was passed to eluate the adsorbate. Then 3 ml of concentrated hydrochloric acid was passed. The activated carbon bed was then washed with an ion-exchanged water until the pH of the washings rose above 4.5. Subsequently, 90 ml of an aqueous 5% methanol solution was passed through the washed activated carbon bed and a maltose isolution having the same composition as that of Example 1 and having methanol added thereto to a methanol concentration of 5% was added similarly. Thereafter, an aqueous 5% methanol solution was passed and the eluate was collected successively in 10-ml fractions. The procedure described above was repeated a total of ten times. The combination of five fractions of the peak sugar elution obtained in each cycle of treatment was assayed to determine the recovery ratio of sugar and the sugar composition and find a possible change due to aging.

The results indicate that in all the cycles, the impurities such as maltotriose and maltotetraose were effectively adsorbed by the activated carbon. In the case of the sample from the tenth cycle, the recovery ratio of sugar was 81.3% and the sugar was composed of 0.4% of glucose, 99.0% of maltose, 0% of maltotriose and 0.6% of others based on the solids content.

EXAMPLE 4

The procedure of Example 1 was followed, except the aqueous 5% methanol solution was replaced with an aqueous 5% acetone solution, the acetone concentration in the maltose solution (of the same composition as that of Example 1) was 5% and the amount of the maltose solution added was such as to correspond to 75.3 mg of sugar per ml of the activated carbon. For the five fractions of the eluate from the peak phase of sugar elution, the recovery ratio of sugar was found to be 73.1% and the sugar was shown to be composed of 0.4% of glucose, 99.1% of maltose, 0% of maltotriose and 0.5% of others based on the solids content.

What is claimed is:

1. A process for purifying a maltose solution by means of activated carbon, which process comprises:
   (a) pretreating the activated carbon by bringing it into contact with the aqueous solution of one organic solvent selected from the group consisting of methanol, ethanol and acetone,
   (b) adding the same organic solvent to the maltose solution being subjected to the treatment until the organic solvent concentration in the solution equals that in the aqueous solution of organic solvent in step (a),
   (c) feeding the organic solvent-containing maltose solution to a bed formed of the pretreated activated carbon,
   (d) feeding the same aqueous solution as that used in step (a) to the activated carbon bed to which the supply of the maltose solution was fed in step (c),
   (e) recovering a maltose-rich eluate from the activated carbon bed, and
   (f) separating the organic solvent from the recovered eluate.

2. The process according to claim 1, wherein the aqueous solution of organic solvent used to pretreat the activated carbon has an organic solvent concentration in the range of from about 4 to about 6%.

3. The process according to claim 1, wherein the feeding of the organic solvent-containing maltose solution to the bed formed of pretreated activated carbon is effected at a temperature in the range of from 50° to 60° C.

4. The process according to claim 1, wherein the amount of the organic solvent-containing maltose solution fed to the bed formed of pretreated activated carbon is such as to correspond to not more than 100 mg of reducing sugar per ml of the activated carbon.

* * * * *